US011986744B2

(12) United States Patent
Bando

(10) Patent No.: US 11,986,744 B2
(45) Date of Patent: May 21, 2024

(54) TOP TOY AND TOP TOY SET

(71) Applicant: TOMY COMPANY, LTD., Tokyo (JP)

(72) Inventor: Yohei Bando, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 17/625,083

(22) PCT Filed: Oct. 28, 2021

(86) PCT No.: PCT/JP2021/039729
§ 371 (c)(1),
(2) Date: Jan. 5, 2022

(87) PCT Pub. No.: WO2023/067820
PCT Pub. Date: Apr. 27, 2023

(65) Prior Publication Data

US 2024/0042338 A1 Feb. 8, 2024

(30) Foreign Application Priority Data

Oct. 22, 2021 (JP) ..... 2021-173209

(51) Int. Cl.
*A63H 1/00* (2019.01)
*A63F 9/16* (2006.01)

(52) U.S. Cl.
CPC ..... *A63H 1/00* (2013.01); *A63F 9/16* (2013.01)

(58) Field of Classification Search
CPC ..... A63H 1/00; A63F 9/16; A63F 2007/367
USPC ..... 446/256, 264
See application file for complete search history.

(56) References Cited

U.S. PATENT DOCUMENTS 4,200,283 A * 4/1980 Andrews ..... A63F 9/16 446/259
4,630,822 A * 12/1986 Massaglia ..... A63F 7/04 273/118 A
4,982,961 A * 1/1991 Ichimura ..... A63F 9/16 446/259
5,518,437 A * 5/1996 Nonaka ..... A63H 1/02 446/259
6,530,817 B1 * 3/2003 Winslow ..... A63H 1/00 446/259
6,626,729 B2 * 9/2003 Osawa ..... A63H 1/00 446/250
7,275,976 B2 * 10/2007 Toriyama ..... A63H 17/262 446/454
7,740,518 B2 * 6/2010 Elliott ..... A63H 1/04 446/256
8,066,543 B2 * 11/2011 Kitamura ..... A63F 9/16 446/259

(Continued)

FOREIGN PATENT DOCUMENTS

JP 3092080 U 11/2002

*Primary Examiner* — Alexander R Niconovich
(74) *Attorney, Agent, or Firm* — IP Business Solutions, LLC

(57) ABSTRACT

A top toy is used in a game table including a guide member having a guide surface on which first teeth are formed at an equal interval. The top toy includes a shaft part, a body being configured on the shaft, and a trunk part being configured on the shaft. The shaft includes second teeth that are engageable with the first teeth on an outer periphery thereof.

22 Claims, 19 Drawing Sheets

(56) References Cited

U.S. PATENT DOCUMENTS 8,568,191 B2 * 10/2013 Rehkemper ..... A63F 9/16 446/259
8,986,066 B2 * 3/2015 Ferreyra ..... A63H 1/02 446/259
9,180,379 B2 * 11/2015 Choi ..... A63H 1/02
9,643,095 B2 * 5/2017 Choi ..... A63H 1/04
9,849,394 B1 * 12/2017 Shindo ..... A63F 9/16
9,901,811 B2 * 2/2018 Shindo ..... A63H 1/00
10,029,185 B2 * 7/2018 Cai ..... A63H 1/18
10,449,438 B2 * 10/2019 Hashiba ..... A63F 9/16
10,695,660 B2 * 6/2020 Muraki ..... A63H 1/00
10,702,767 B2 * 7/2020 Campos ..... A63F 9/16
11,154,769 B2 * 10/2021 Schultheis ..... A63H 1/00
11,311,796 B2 * 4/2022 Schultheis ..... A63H 1/00
11,883,754 B2 * 1/2024 Schultheis ..... A63F 9/16
11,904,251 B2 * 2/2024 Muraki ..... A63H 1/00
2003/0064660 A1 * 4/2003 Matsukawa ..... A63H 1/04 446/256
2008/0194173 A1 * 8/2008 Tiefel ..... A63H 1/04 446/236
2009/0253345 A1 * 10/2009 Ujita ..... A63H 1/04 446/263
2010/0159798 A1 * 6/2010 Bertrand ..... A63H 1/02 446/259
2011/0171876 A1 * 7/2011 Ujita ..... A63H 1/00 446/264
2011/0256794 A1 * 10/2011 Horikoshi ..... A63H 1/04 446/259
2011/0256795 A1 * 10/2011 Ujita ..... A63H 1/00 446/264
2011/0256796 A1 * 10/2011 Ujita ..... A63H 1/00 446/264
2016/0151716 A1 * 6/2016 Nagai ..... A63H 29/22 446/237
2017/0239558 A1 * 8/2017 Shindo ..... A63H 1/00
2018/0104603 A1 * 4/2018 Muraki ..... A63H 1/02
2018/0339236 A1 * 11/2018 Horikoshi ..... A63H 1/04
2019/0111352 A1 * 4/2019 Muraki ..... A63H 1/04
2020/0269146 A1 * 8/2020 Muraki ..... A63H 1/02
2020/0269147 A1 * 8/2020 Muraki ..... A63H 1/02
2021/0220724 A1 * 7/2021 Schultheis ..... A63F 9/16
2023/0211243 A1 * 7/2023 Hama ..... A63H 1/10 446/259
2024/0066417 A1 * 2/2024 Muraki ..... A63H 1/02

* cited by examiner

TOP TOY AND TOP TOY SET

CROSS-REFERENCE TO THE RELATED APPLICATIONS

This is a national phase application of PCT/JP2021/039729 claiming priority to Japanese Patent Application No. 2021-173209 filed on Oct. 22, 2021. The entire content of Japanese Patent Application No. 2021-173209 is incorporated herein by reference.

TECHNICAL FIELD

The present invention relates to a top toy and a top toy set.

BACKGROUND ART

In the past, a dedicated top toy game table was used for battling top toys with each other (Patent Document 1, for example).

With this top toy game table, a protruding wall that partitions the battlefield is provided around the battlefield. When a top toy released into the battlefield moves around and contacts the wall, it moves along the protruding wall, or is struck by the protruding wall and returns to the center of the battlefield again, expanding the battle.

Patent Document 1: Registered Japanese Utility Model Publication No. 3092080

SUMMARY

Problems the Invention is Intended to Solve

The speed at which the top toy noted in Patent Document 1 moves around is at its maximum immediately after the top toy is let loose, and generally after that it only attenuates as the rotational energy decreases, and even if it contacts the protruding wall, the top toy slides along the protruding wall in accordance with rotation of the top toy, and though a certain amount of change is seen in the speed at which it moves around, it only moved around within a predictable range.

In consideration of such circumstances, the present invention provides a top toy and a top toy set in which it is possible to change how they move around.

Means for Solving the Problems

A top toy is used in a game table including a guide member having a guide surface on which first teeth are formed at an equal interval. The top toy includes a shaft part, a body being configured on the shaft, and a trunk part being configured on the shaft. The shaft includes second teeth that are engageable with the first teeth on an outer periphery thereof.

DETAILED DESCRIPTION OF THE PREFERRED EMBODIMENTS

Following, a top toy set of an embodiment of the present invention is explained.

Figure 1:
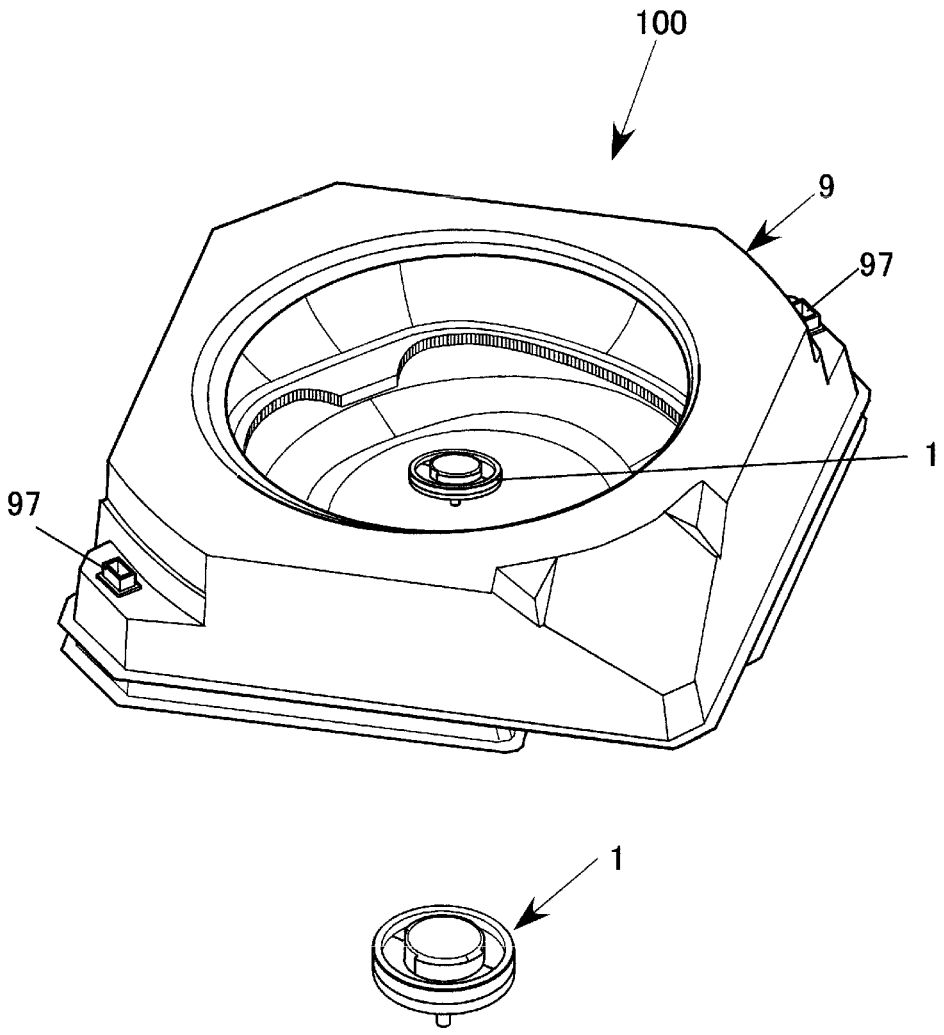
FIG. 1 is a perspective view of a top toy set of an embodiment.

FIG. 1 is a perspective view of a top toy set 100 of an embodiment.

The top toy set 100 of the present embodiment comprises a top toy 1, and a top toy game table 9 on which to battle top toys with each other.

Top Toy Game Table 9

Figure 2:
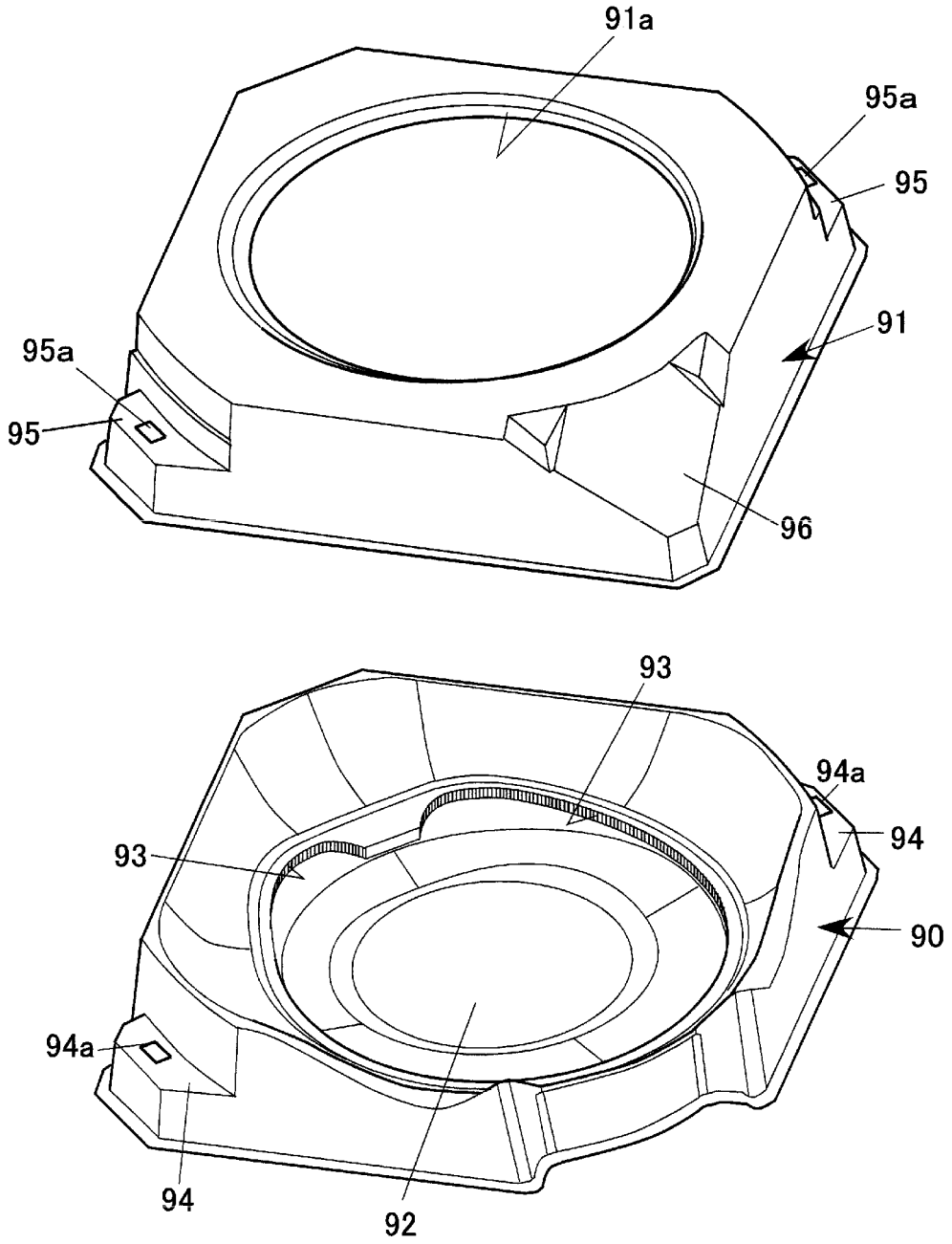
FIG. 2 is an exploded perspective view of a top toy game table.
Figure 3:
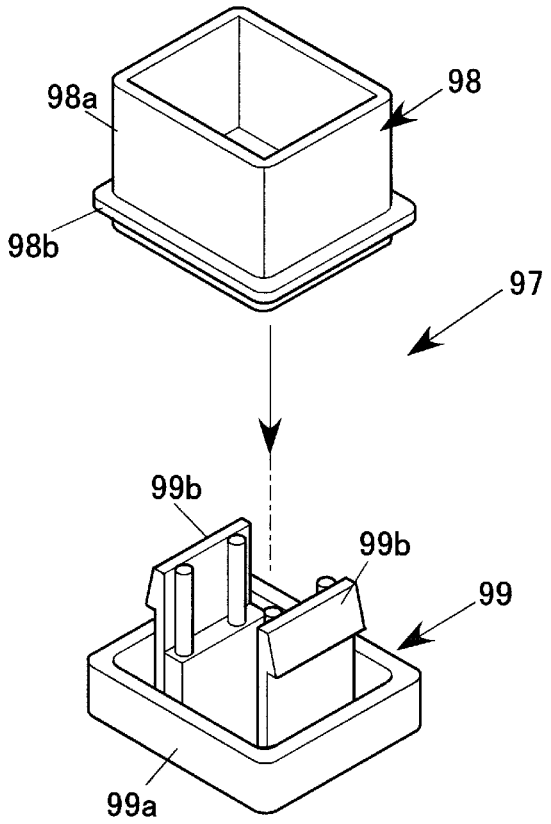
FIG. 3 is a perspective view of a fastener.

FIG. 2 is an exploded perspective view of a top toy game table 9. FIG. 3 is a perspective view of a fastener 97.

Overall, the top toy game table 9 is approximately square in the plane view and is box-shaped, and comprises: a base board 90 that constitutes a battlefield 92 of the top toy 1; a cover body 91 that can be attached and detached with the base board 90; and a fastener 97 (see FIG. 3) for fixing the cover body 91 to the base board 90.

The base board 90 is approximately square in the plane view and has a shape with one corner missing. The base board 90 has a prescribed thickness, with the top surface being a bowl-shaped concave surface, and the center part constituting the battlefield 92. Inside the concave surface of the base board 90, two sets of band-shaped guide members 93 are provided extending in the horizontal direction to partition the battlefield 92. Each set of guide members 93 is formed in a C-shape in the plane view, and teeth are formed on the inner surface at equal intervals in the lengthwise direction. The two sets of guide members 93 are arranged so that the C-shaped recessed parts face each other, and both end parts of each set of guide members 93 extend facing the center side of the battlefield 92. As a result, it is possible to move the top toy 1 along the guide member 93 while being accelerated, and to guide it to collide with another top toy that remains in the center.

A step part 94 is formed at each of the three corners of the base board 90. A rectangular hole 94*a* is formed in the step part 94.

The cover body 91 is also approximately square in the plane view. The cover body 91 has a prescribed thickness, and has a shape that covers the side and top of the outer periphery part of the base board 90 in the plane view. A circular window 91*a* is formed on the top surface of the cover body 91, and in a state mounted on the base board 90, the battlefield 92 is directly visible from this window 91*a*.

A step part 95 is formed on the part corresponding to each of the three corners of the base board 90 on the cover body 91. A rectangular hole 95*a* is formed on the step part 95. In a state with the cover body 91 mounted on the base board 90, the step part 95 and the step part 94 are superimposed, and the rectangular hole 95*a* and the rectangular hole 94*a* match vertically.

Of the cover body 91, a corner 96 on which the step part 95 is not formed is in a state jutting out inclined outward and downward from the base board 90. When the top toy 1 that was played in a battle and jumped out from the base board 90 contacts this corner 96, it is ejected to outside the base board 90.

FIG. 3 is a perspective view of the fastener 97.

The fastener 97 is configured from a female fitting 98 and a male fitting 99.

The female fitting 98 comprises a cylinder part 98*a*, and a flange part 98*b* is formed directly above the bottom edge of the outer periphery of the cylinder part 98*a*. When the female fitting 98 fixes the cover body 91 to the base board 90, the flange part 98*b* is contacted on the edge of the rectangular hole 95*a* of the step part 95 from above.

The male fitting 99 has a structure in which a pair of claws 99*b* are erected in a recess of a rectangular tray-shaped base 99*a*.

When the male fitting 99 fixes the cover body 91 to the base board 90, the edge of the base 99*a* is contacted on the edge of the rectangular hole 94*a* of the step part 94 from below, and the claw 99*b* is inserted in a hole of the cylinder part 98*a* of the female fitting 98 from below, and is engaged with the top end of the cylinder part 98*a*. As a result, the cover body 91 is fixed to the base board 90.

Figure 4:
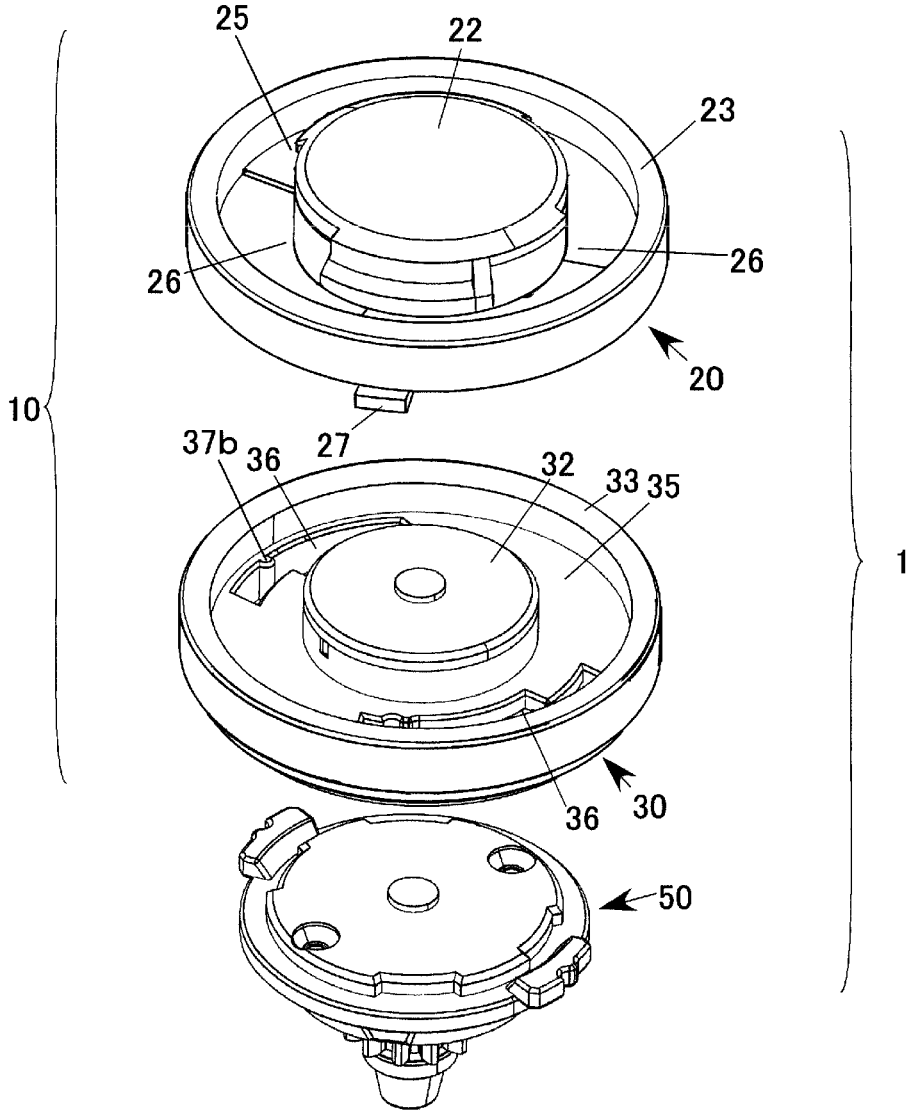
FIG. 4 is an exploded perspective view of a top toy.

Top Toy 1 FIG. 4 is an exploded perspective view of the top toy 1.

This top toy 1, roughly divided, comprises a trunk part 10 and a shaft part 50.

Trunk Part 10

The trunk part 10 is configured from an upper trunk part 20 and a lower trunk part 30.

1. Upper Trunk Park 20

The upper trunk part 20 is a composite configured in a disk shape. In the upper trunk part 20, in the plane view, between a circular center part 22 and a ring-shaped outer periphery part 23 is partitioned by an annular groove 25, and two arc-shaped slits 26 are partially formed on the bottom of the annular groove 25. The two slits 26 are formed at positions with point symmetry to each other with respect to the axial center.

Furthermore, two L-shaped outward facing joining claws 27 are formed on the bottom surface of the upper trunk part 20. The two joining claws 27 are provided at positions that have point symmetry to each other with respect to the axial center.

2. Lower Trunk Part 30

The lower trunk part 30 is a composite configured in a disk shape. In the lower trunk part 30, in the plane view, between a circular center part 32 and a ring-shaped outer periphery part 33 is partitioned by an annular groove 35, with two approximately arc-shaped slits 36 formed on the bottom of the annular groove 35. The two slits 36 are formed at positions that have point symmetry to each other with respect to the axial center. The annular groove 35 has a broader width than the annular groove 25.

On the outer edge of one end in the circumferential direction of each slit 36, a joining claw (not illustrated) that engages with the joining claw 27 of the upper trunk part 20 and joins the upper trunk part 20 and the lower trunk part 30 is formed, and at the outer edge of the other end in the circumferential direction of each slit 36, a fitting projection 37*b* is formed that is fitted in a fitting recess 53*g* described later and that joins the lower trunk part 30 and the shaft part 50. The two joining claws (not illustrated) are provided at positions having point symmetry to each other with respect to the axial center, and the two fitting projections 37*b* are provided at positions having point symmetry with each other with respect to the axial center.

Shaft Part 50

Figure 5:
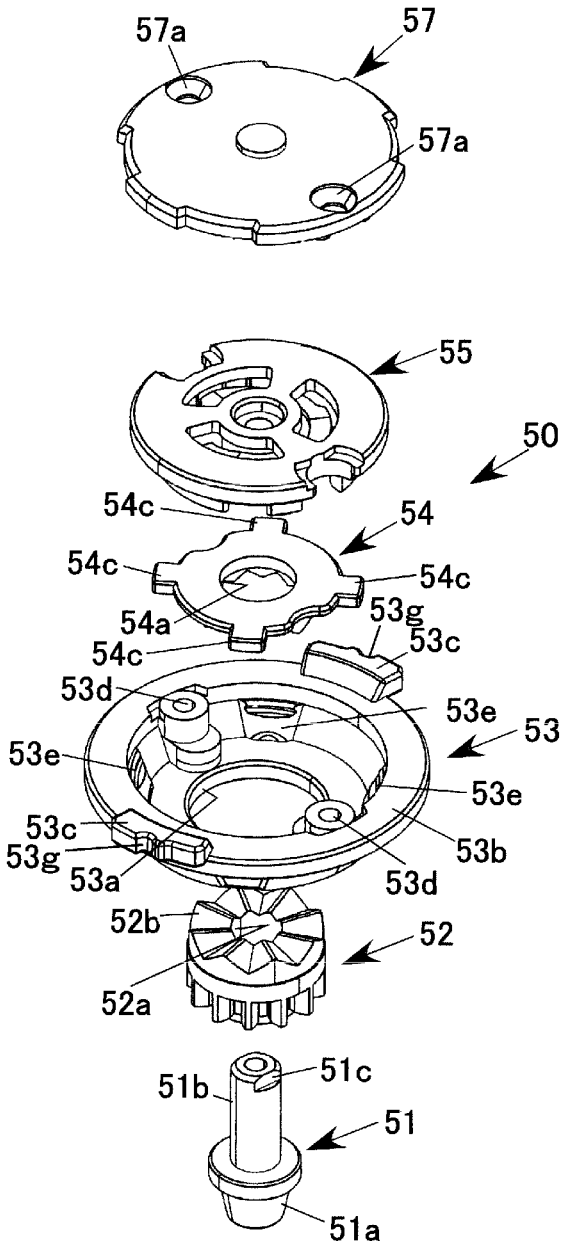
FIG. 5 is an exploded perspective view of a shaft part of the top toy seen from the top surface side.
Figure 6:
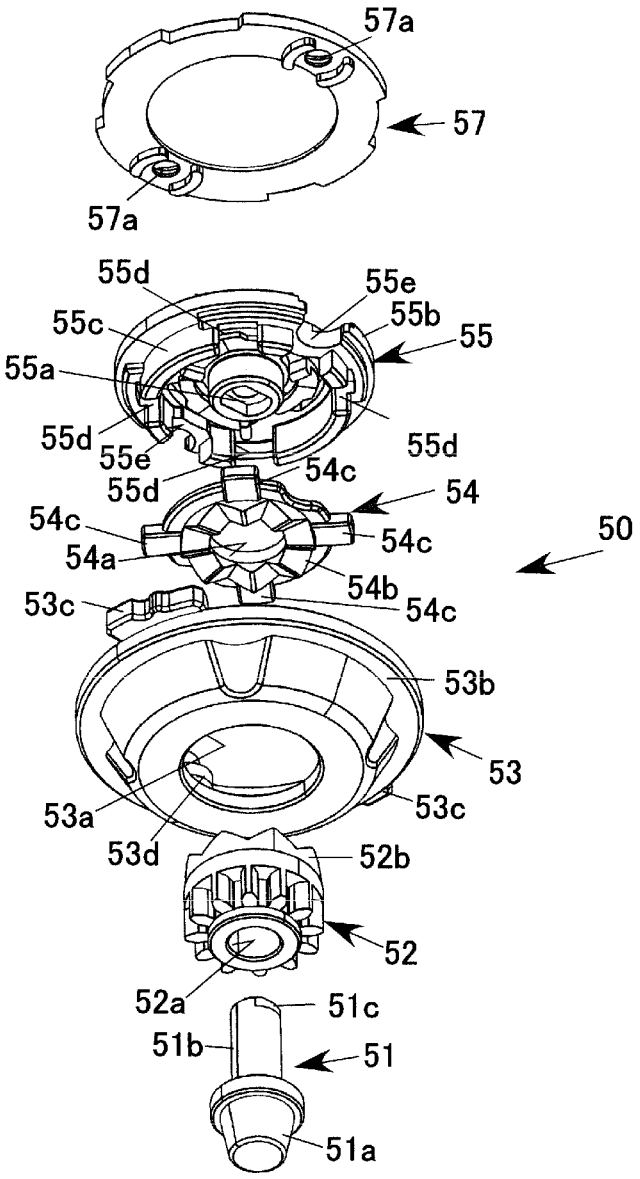
FIG. 6 is an exploded perspective view of the shaft part seen from the bottom surface side.

FIG. 5 is an exploded perspective view of the shaft part 50 of the top toy 1 seen from the top surface side, and FIG. 6 is an exploded perspective view of the shaft part 50 seen from the bottom surface side.

A rotation shaft 51 comprises an inverted cone-shaped tapered shaft tip 51*a*, and a shaft body 51*b* connected continuously with the shaft tip 51*a*. The top edge diameter of the shaft tip 51*a* is greater than the diameter of the shaft body 51*b*, and the top edge of the shaft tip 51*a* juts out outward in a ring shape from the shaft body 51*b*.

Two D-cut parts 51*c* are formed on the top edge part of the shaft body 51*b*. The two D-cut parts 51*c* are provided at positions having point symmetry with each other with respect to the axial center.

This rotation shaft 51 is fixed to a shaft fixing member 55 by the top edge part of the shaft body 51*b* that has passed through a hole 52*a* of a gear 52, a hole 53*a* of a cover body 53, and a hole 54*a* of a claw member 54 from below being fitted in a fitting hole 55*a* of the shaft fixing member 55.

The gear 52 is engageable with the teeth of the guide member 93, and the ring-shaped jutting part of the top edge of the shaft tip 51*a* of the rotation shaft 51 is supported from below. A plurality of engaging claws 52*b* are formed at equal intervals in the circumferential direction on the top edge surface of this gear 52.

The cover body 53 is formed in a deep round plate shape, and a hole 53*a* into which the top edge part of the gear 52 fits is formed on the bottom. An outward flange 53*b* is formed on the top edge of the cover body 53. Two fitting protrusions 53*c* are formed to jut outward on the outward flange 53*b*. The two fitting protrusions 53*c* are provided at positions having point symmetry with each other with respect to the axial center. The fitting recess 53*g* is formed on the fitting protrusion 53*c*. The fitting protrusions 53*c* are fit into the slits 36 so that the fitting recesses 53*g* and the fitting projection 37*b* are fitted. As a result, the shaft part 50 and the lower trunk part 30 are joined.

Two bosses with screw holes 53*d* are formed inside the cover body 53. The two bosses 53*d* are provided at positions having point symmetry with each other with respect to the axial center.

Four fitting recesses 53*e* into which a fitting protrusion 54*c* described later is fitted are formed at equal intervals in the circumferential direction on the inner surface of the cover body 53.

The claw member 54 is formed in a disk shape, and a plurality of engaging claws 54*b* that can engage with the engaging claws 52*b* of the gear 52 are formed in the circumferential direction on the bottom surface. Four fitting protrusions 54*c* that fit loosely in the fitting recesses 53*e* are formed to jut out outward on the outer periphery part of the claw member 54. The claw member 54 and the engaging claws 52*b* constitute the engagement clutch. This engagement clutch, in a half-clutch state, rolls the gear 52 along the guide member 93.

The shaft fixing member 55 is configured in a ceilinged cylinder shape. This shaft fixing member 55 is fitted inside the cover body 53, and the claw member 54 is housed internally between it and the cover body 53. On a cylindrical part 55*c* below a top plate 55*b* of the shaft fixing member 55, formed are four notches 55*d* into which fit the fitting protrusions 54*c* of the claw member 54, and the claw member 54 can move vertically within a prescribed range.

The outer periphery part of the top plate 55*b* of the shaft fixing member 55 juts out in ring form from the outer periphery of the cylindrical part 55*c*. Two arc-shaped notches 55*e* are formed on this jutting part. The two notches 55*e* are provided at positions having point symmetry with each other with respect to the axial center. Each notch 55*e* abuts the outer periphery part of the boss 53*d*.

Figure 7:
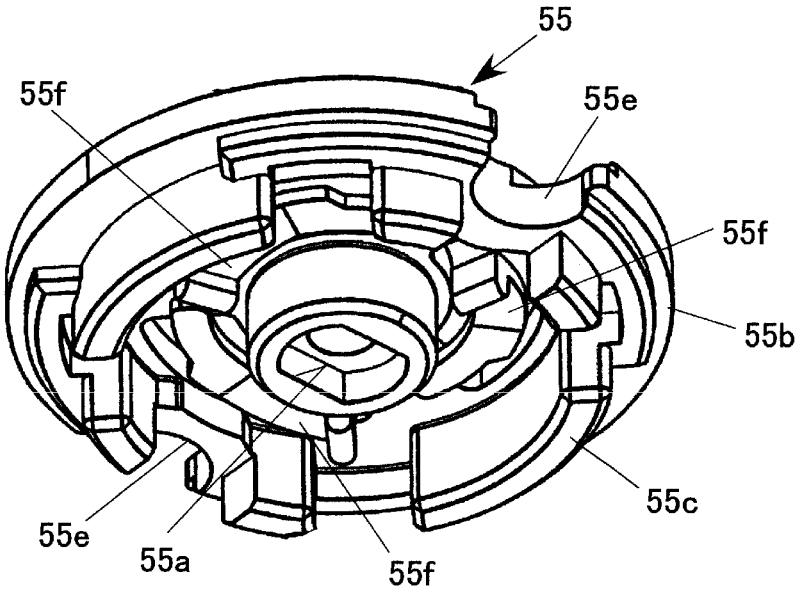
FIG. 7 is a perspective view of a shaft fixing member seen from the bottom surface side.

Furthermore, as shown in FIG. 7, three plate springs 55*f* of a cut and bent shape are provided at equal intervals in the circumferential direction on the top plate 55*b* of the shaft fixing member 55. The plate springs 55*f* press the claw member 54 downward, and operate to press the engaging claws 54*b* against the engaging claws 52*b*.

A disk-shaped top plate 57 is provided above the shaft fixing member 55.

The top plate 57 forms the top surface of the shaft part 50, and screw insertion holes 57*a* are formed at the parts corresponding to the bosses 53*d*.

The shaft part of male screws (not illustrated) passes through the screw insertion holes 57*a* from above, and by screwing the male screws with the female screws of the bosses 53*d*, the top plate 57 is fixed to the cover body 53.

Top Toy 1 Assembly Method

The upper trunk part 20 and the lower trunk part 30 are butted from the axial direction, and the joining claws 27 of the upper trunk part 20 are inserted in the slits 36 of the lower trunk part 30 from above. The upper trunk part 20 is then rotated in the clockwise direction with respect to the lower trunk part 30. As a result, the joining claws 27 of the upper trunk part 20 are engaged with the joining claws (not illustrated) of the lower trunk part 30, and the upper trunk part 20 and the lower trunk part 30 are joined.

Next, the lower trunk part 30 to which the upper trunk part 20 is attached and the shaft part 50 are butted from the axial direction, and the fitting recesses 53*g* and the fitting projections 37*b* are fitted, and the fitting protrusions 53*c* are fitted into the slits 36. As a result, the shaft part 50 and the lower trunk part 30 are joined.

Top Toy 1 Rotational Energization

Rotational energization of the top toy 1 is done using a launcher (not illustrated). The launcher comprises a fork inserted in the slit 26 of the upper trunk part 20, and a rotation mechanism that rotationally operates the fork. The fork is inserted in the slit 26 of the upper trunk part 20, and by the fork being rotationally operated by the rotation mechanism, the top toy 1 is rotationally energized. The rotationally energized top toy 1 is released from the launcher.

Operation

Figure 8:
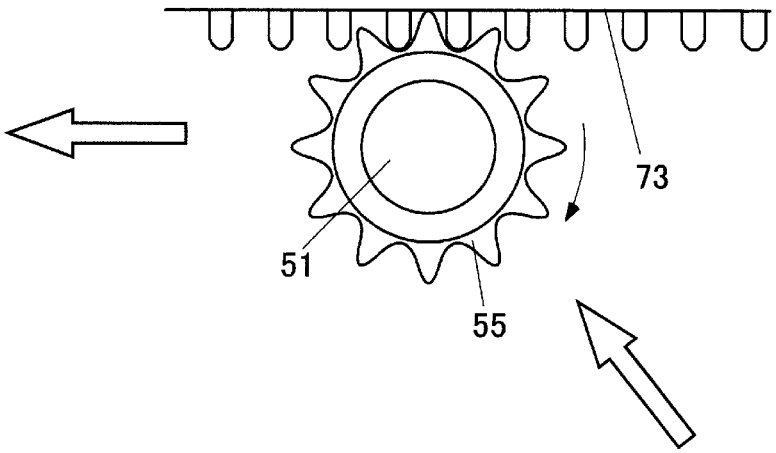
FIG. 8 is a drawing showing the operation of the top toy.

When the top toy 1 is released into the battlefield 92, it moves around in reaction in the direction opposite to the rotation direction of the top toy 1. At this time, the gear 52 rotates integrally with the rotation shaft 51. By moving around, the gear 52 of the top toy 1 contacts the guide member 93. By the impact force at this time, the gear 52 rotates relatively in resistance to the energizing force of the plate springs 55*f* with respect to the rotation shaft 51 and the impact is mitigated. By doing this, it is easier for the top toy 1 to temporarily stay near the guide member 93, and the probability of the gear 52 engaging with the teeth of the guide member 93 improves. Then, in the top toy 1, as shown in FIG. 8, when the gear 52 engages with the teeth of the guide member 93, in a half-clutch state, the gear 52 is rotated in accordance with the rotation of the rotation shaft 51, and moves along the guide member 93, and the movement of the top toy 1 is accelerated. In other words, the rotation of the top toy 1 is easier to transmit to the guide member 9, and it is possible to accelerate the movement of the top toy 1.

Other Shaft Part 50A

Figure 9:
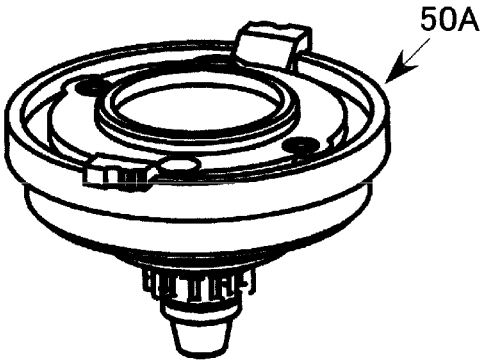
FIG. 9 is a perspective view of another shaft part.
Figure 10:
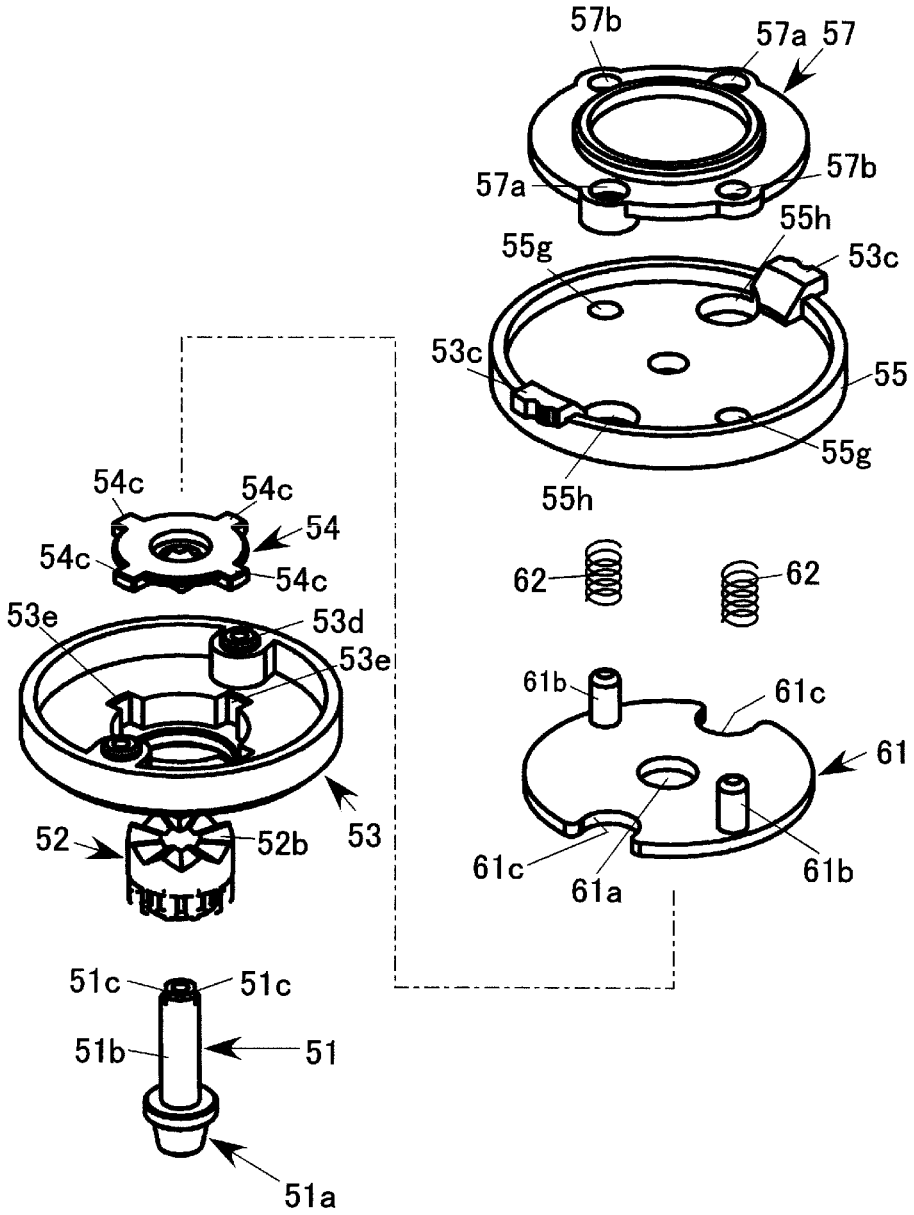
FIG. 10 is an exploded perspective view of the other shaft part seen from the top surface side.
Figure 11:
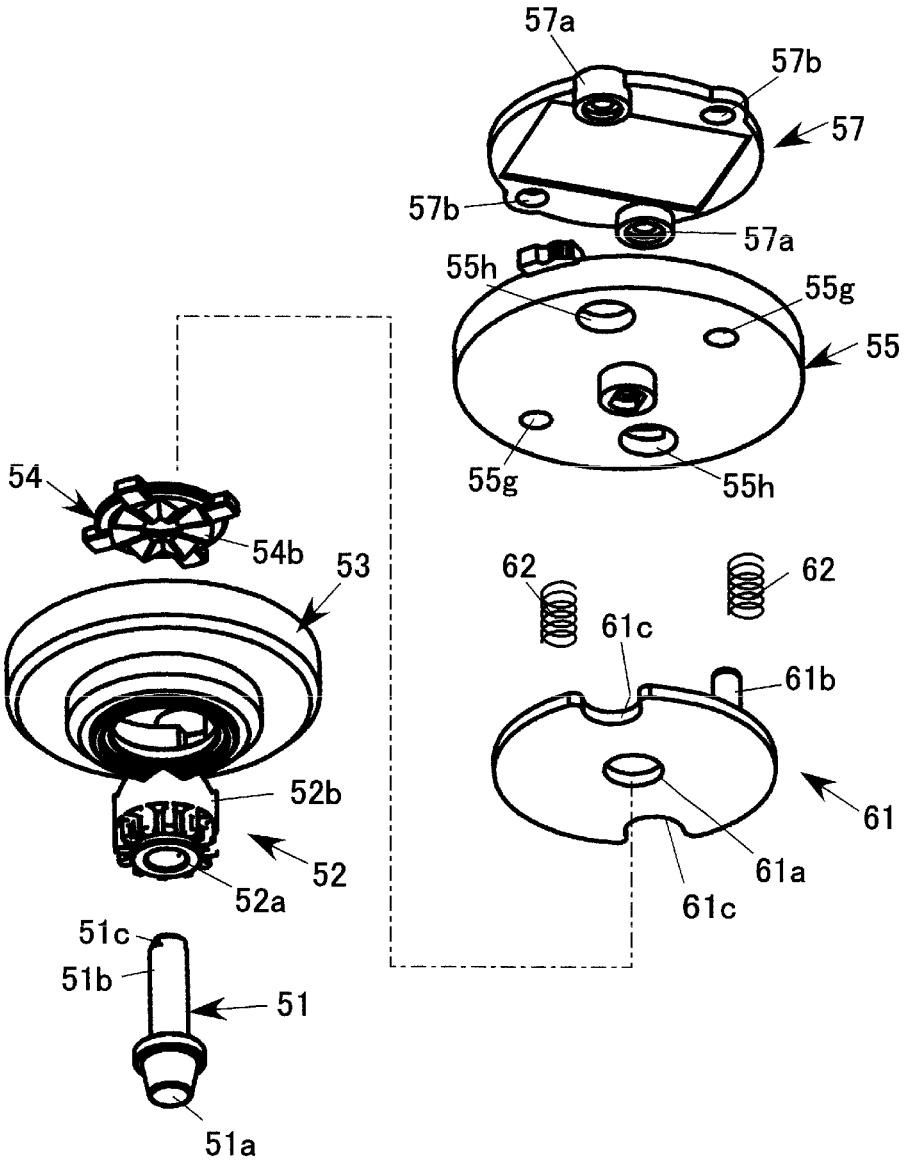
FIG. 11 is an exploded perspective view of the other shaft part seen from the bottom surface side.

FIG. 9 is a perspective view of another shaft part 50A. FIG. 10 is an exploded perspective view of the other shaft part 50A seen from the top surface side. FIG. 11 is an exploded perspective view of the other shaft part 50A seen from the bottom surface side. In the shaft part 50A, parts that correspond to constituent elements of the abovementioned shaft part 50 are given the same code numbers, and the explanation thereof will be omitted as appropriate.

The main difference between this shaft part 50A and the abovementioned shaft part 50 is that with the shaft part 50, the pressing of the engaging claws 54*b* on the engaging claws 52*b* was performed by the plate springs 55*f*, whereas with the shaft part 50A, the pressing of the engaging claws 54*b* on the engaging claws 52*b* is performed by coil springs 62.

To use this kind of configuration, with the shaft part 50A, a pressing plate 61 is provided between the claw member 54 and the shaft fixing member 55.

The pressing plate 61 is configured in a disk shape, and a hole 61*a* through which the shaft body 51*b* of the rotation shaft 51 is inserted through the center. Guide rods 61*b* are erected on the top surface of the pressing plate 61 at positions having point symmetry with respect to the axial center, and the guide rods 61*b* are inserted in the guide holes 55*g* of the shaft fixing member 55, and the guide holes 57*b* of the top plate 57. Also, the coil springs 62 are wound on the guide rods 61*b*, and the pressing plate 61 energizes the claw member 54 toward the gear 52 side. It is possible to adjust the strength of the engagement clutch of the claw member 54 and the engaging claw 54*b* by the guide rods 61*b* being pressed from above, and providing a part that regulates the upward movement of the claw member 54.

Two notches 61*c* are formed on the pressing plate 61. The two notches 61*c* are provided at positions having point symmetry with each other with respect to the axial center. The notches 61*c* are abutted on the outer periphery part of the bosses 53*d*.

In addition, this shaft part 50A differs from the shaft part 50 with fine points such as the point that fitting protrusions 53*c* and screw insertion holes 55*h* are provided on the shaft fixing member 55, but overall they have the same structure.

With the top toy having the shaft part 50A configured in this way, the same action and effect as the top toy 1 are exhibited.

Other Top Toy 1A

Figure 12:
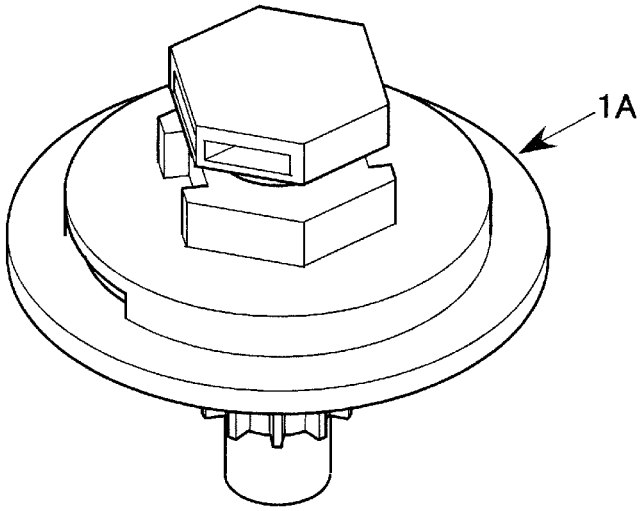
FIG. 12 is a perspective view of another top toy.
Figure 13:
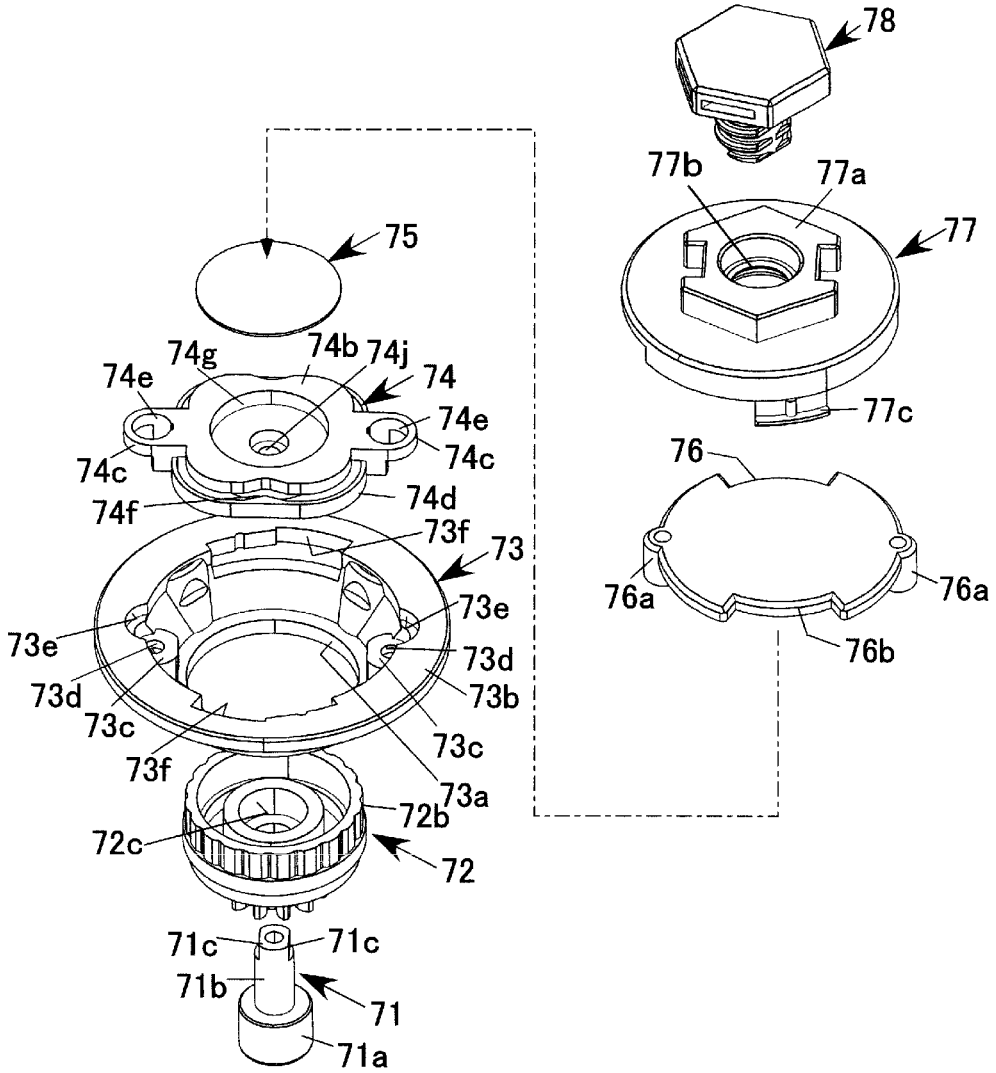
FIG. 13 is an exploded perspective view of the other top toy seen from the top surface side.
Figure 14:
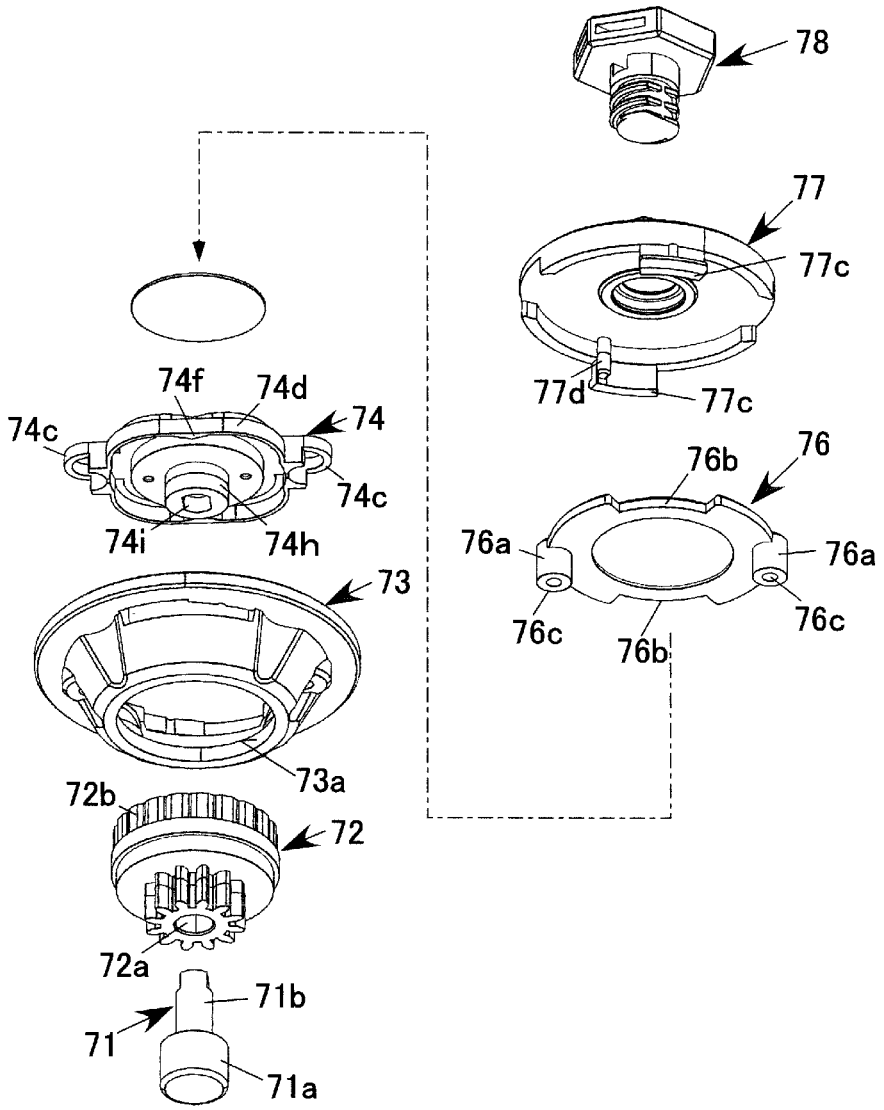
FIG. 14 is an exploded perspective view of the other top toy seen from the bottom surface side.

FIG. 12 is a perspective view of another top toy 1A. FIG. 13 is an exploded perspective view of the other top toy 1A seen from the top surface side. FIG. 14 is an exploded perspective view of the other top toy 1A seen from the bottom surface side.

A rotation shaft 71 of this top toy 1A comprises a shaft tip 71*a* with a large diameter in a cylinder shape, and a shaft body 71*b* connected continuously with the shaft tip 71*a*.

Two D-cut parts 71*c* are formed on the top edge part of the shaft body 71*b*. The two D-cut parts 71*c* are provided at positions having point symmetry with each other with respect to the axial center.

The shaft body 71*b* of the rotation shaft 71 passes through a hole 72*a* of a gear 72 and a hole 73*a* of a cover body 73 from below, and the top edge part is fitted in a fitting hole 74*i* of the bottom surface of a shaft fixing member 74.

Engaging parts 72*b* made from wave shaped recesses and projections formed along the entire circumference in the circumferential direction are formed on the outer periphery of the top edge of the gear 72.

A cylinder part is erected inside the top surface recess of the gear 72, and a fitting recess 72*c* is formed by this cylinder part.

The cover body 73 is formed in a deep round plate shape. An outward flange 73*b* is formed on the top edge of the cover body 73.

Two bosses 73*c* are formed on the inside of the cover body 73. The two bosses 73*c* are provided at positions having point symmetry to each other with respect to the axial center.

A screw insertion hole 73*d* is formed on each boss 73*c*. Round arc-shaped notches 73*e* are formed on the outside of each boss 73 at the inner edge part of the outward flange 73*b*.

Furthermore, other notches 73*f* are formed on parts separated by 90 degrees in the circumferential direction from the notches 73*d* at the inner edge part of the outward flange 73*b*. The notches 73*f* are provided over the part under the outward flange 73*b*. The two notches 73*f* are provided at positions having point symmetry to each other with respect to the axial center.

The shaft fixing member 74 comprises a base 74*b* having an approximately rectangular shape in the plane view.

Two tongue pieces 74*c* corresponding to the notches 73*e* are attached on the outside of the base 74*b*, and two belt-shaped elastic pieces 74*d* with both ends connected to the tongue pieces 74*c* are attached. A screw insertion hole 74*e* is formed on each tongue piece 74*c*. An engaging projection 74*f* is formed at the lengthwise direction center of the inner surface of each elastic piece 74*d*. The elastic pieces 74*d* and the engaging parts 72*b* constitute the mechanical clutch. This mechanical clutch, in a half-clutch state, rolls the gear 72 along the guide member 93.

Furthermore, a fitting projection 74*h* that fits into the inside of the abovementioned fitting recess 72*c* is formed on the bottom surface of the base 74*b*, and a fitting hole 74*i* into which fits the top edge part of the shaft body 71*b* of the rotation shaft 71 is formed on this fitting projection 74*h*.

A circular recess 74*g* is also formed on the top surface of the base 74*b*, and a counterbore hole 74*j* is formed at the center. The shaft part of a male screw (not illustrated) passes through the counterbore hole 74*j* from above, and that male screw screws with a female screw (not illustrated) of the shaft body 51*b* of the rotation shaft 51.

A circular plate 75 is fitted in the circular recess 74*g* of the top surface of a base 74*a*.

A lid body 76 provided above the circular plate 75 is formed in approximately a disk shape.

Two bosses with screw holes 76*a* corresponding to the bosses 73*c* are attached on the lid body 76, and two notches 76*b* are formed corresponding to the notches 73*f*. Male screws (not illustrated) that pass through the screw insertion holes 73*d* of the cover body 73 and the screw insertion holes 74*e* of the shaft fixing member 74 from below are screwed into female screws (not illustrated) of the bosses 76*a*. In a state with this lid body 76 attached to the cover body 73, predetermined gaps are formed between the notches 76*b* and the notches 73*f*.

A top plate 77 is formed in a disk shape, and an approximately hexagonal convex part 77*a* in the plane view is formed on the top surface center. A hole 77*b* in which a female screw is formed is formed at the center of the convex part 77*a*, and a bolt 78 screws into the female screw.

Two L-shaped outward facing claws 77*c* corresponding to the notches 76*b* are formed on the bottom surface of the top plate 77. The two outward facing claws 77*c* are provided at positions having point symmetry with each other with respect to the axial center. An abutting projection 77*d* is formed on the inside of each outward facing claw 77*c*. This top plate 77 has the outward facing claws 77*c* inserted in gaps between the notches 76*b* and the notches 73*f*, and by the outward facing claws 77*c* being engaged with the edge of the notches 73*f*, is attached to the cover body 73.

Figure 15A:
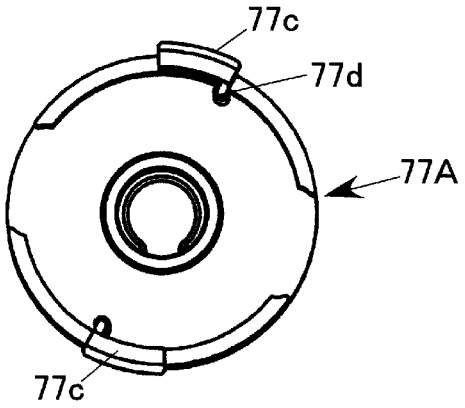
FIG. 15A is a bottom view of one exchangeable top plate.
Figure 15B:
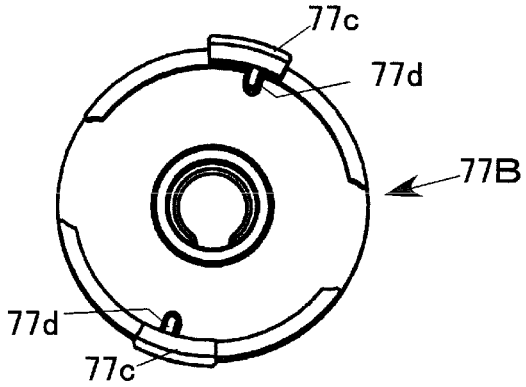
FIG. 15B is a bottom view of another exchangeable top plate.
Figure 15C:
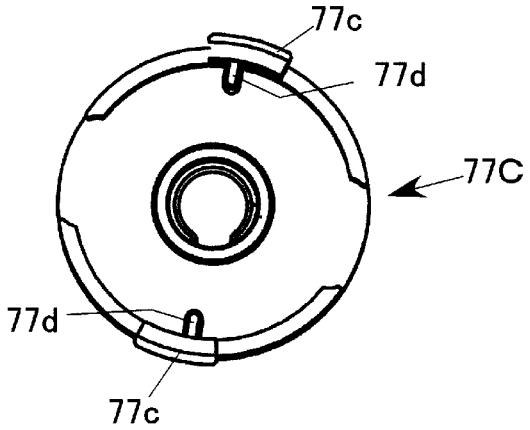
FIG. 15C is a bottom view of yet another exchangeable top plate.

In FIG. 15A to FIG. 15C, shown are three top plates 77A, 77B, 77C with mutually different formation positions of the abutting projections 77*d* with respect to the outward facing claws 77*c*.

With these three top plates 77A, 77B, 77C, the formation position of the abutting projection 77*d* differs in the circumferential direction. The abutting projection 77*d* of the top plate 77 abuts the elastic piece 74*d* of the shaft fixing member 74, and so that the engaging projection 74*f* of the elastic piece 74*d* is reliably engaged with the engaging part 72*b* of the gear 72, the lengths of the abutting projections 77*d* of the top plates 77A, 77B, 77C also differ. These three top plates 77A, 77B, 77C are configured to be exchangeable. By exchanging these top plates 77A, 77B, 77C, it is possible to change the abutting position of the abutting projection 77*d* and the elastic piece 74*d*.

Figure 16:
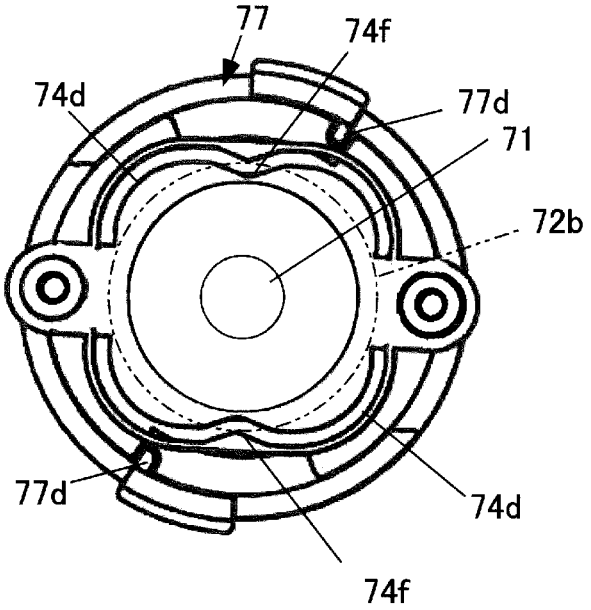
FIG. 16 is a drawing showing the relationship between the engaging projection and the engaging part of one top plate.

FIG. 16 is a drawing showing the relationship between the engaging projections 74*f* and the engaging parts 72*b* when using the top plate 77A.

As shown in the drawing, by the abutting projections 77*d* of the top plate 77A abutting the elastic pieces 74*d* of the shaft fixing member 74, the engaging projections 74*f* of the elastic pieces 74*d* engage with the engaging parts 72*b* of the gear 72. In this case, when the abutting position of the abutting projections 77*c* and the elastic pieces 74*d* changes, the pressing force of the engaging projections 74*f* on the engaging parts 72*b* changes. Therefore, by exchanging the top plates 77A, 77B, 77C, the operation timing of the mechanical clutch is changed, and it is possible to change the characteristics of how the top toy 1A moves around.

Specifically, when using the abutting member 77A for which the abutting projections (abutting parts) 77*d* are formed at a relatively far distance from the engaging projections 74*f*, it is easy for the elastic pieces 74*d* to deform, so it is easier for the teeth of the gear 72 and the teeth of the guide member 93 to engage, and when using the abutting member 77C for which the abutting projections (abutting parts) 77*d* are formed at a relatively close distance from the engaging projections 74*f*, engaging is difficult, but after the teeth of the gear 72 and the teeth of the guide member 93 engage, it is easy to increase the speed at which the top toy 1A moves around.

This top toy 1A is rotationally energized by a launcher that is different from the launcher that energizes the top toy 1, and the same operation and effect as that of the top toy 1 are exhibited.

Modification Example Shaft Part 50B

Figure 17:
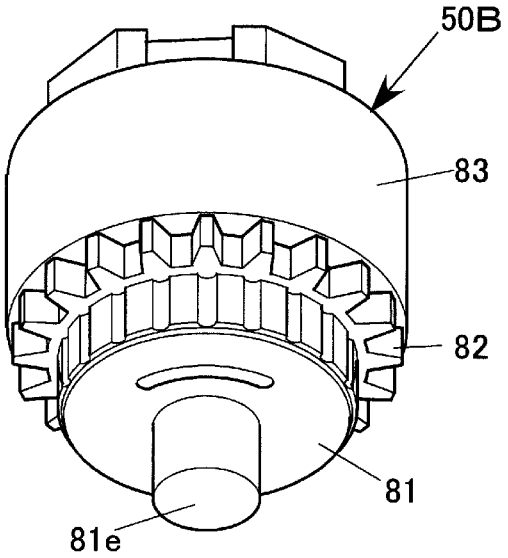
FIG. 17 is a perspective view of a modification example of the shaft part.
Figure 18:
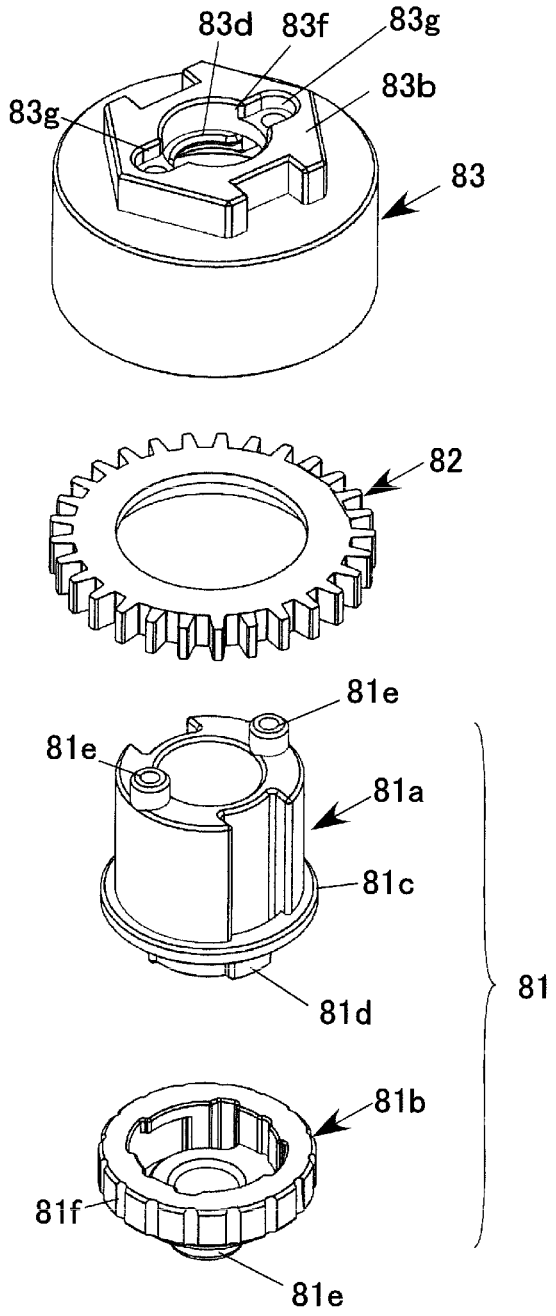
FIG. 18 is an exploded perspective view of the modification example of the shaft part in a state seen from the top surface side.
Figure 19:
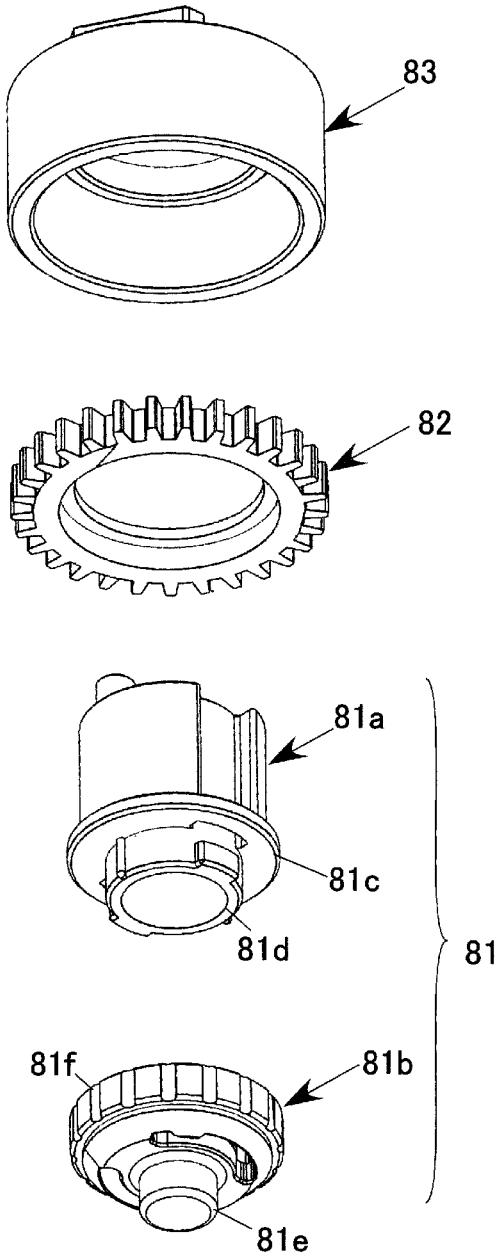
FIG. 19 is an exploded perspective view of the modification example of the shaft part in a state seen from the bottom surface side.

FIG. 17 is a perspective view of a shaft part 50B which is a modification example. FIG. 18 is an exploded perspective view of the shaft part 50B in a state seen from the top surface side. FIG. 19 is an exploded perspective view of the shaft part 50B in a state seen from the bottom surface side.

With this shaft part 50B of the modification example, a rotation shaft 81 comprises a shaft body 81*a*, and a shaft tip member 81*b*.

The shaft body 81*a* is formed in a cylinder shape with a large diameter, and an outward flange 81*c* is formed on the bottom edge part. The bottom edge portion of the outward flange 81*c* becomes a fitting part 81*d* in which recesses and projections are formed on the outer peripheral surface.

Meanwhile, on the bottom of the shaft tip member 81*b*, cylinder shaped small projections 81*e* that become grounding parts are formed, and the portion above that becomes a large-diameter bottomed cylinder part 81*f*. The fitting part 81*d* of the shaft body 81*a* is fitted inside the recess of this bottomed cylinder part 81*f*.

An annular gear 82 is fitted on the shaft body 81*a* from above. Two bosses with screw holes 81*e* are formed on the top surface of the shaft body 81*a*. The two bosses 81*e* are provided at positions having point symmetry to each other with respect to the axial center. A friction clutch is configured between the shaft body 81*a* and the annular gear 82. In a half-clutch state, this friction clutch rolls the annular gear 82 along the guide member 93.

The reason the recess is formed on the outer periphery of the shaft body 81*a* is to adjust the operation timing of the friction clutch.

A ceilinged cylindrical shaped shaft fixing member 83 is covered on the shaft body 81*a*.

The annular gear 82 is sandwiched by the bottom edge part of the shaft fixing member 83 and the outward flange 81*c*.

Furthermore, an approximately hexagonal convex part 83*b* is formed on the shaft fixing member 83, and a female screw 83*d* is formed in a center hole 83*f* of this convex part 83*b*. Two counterbore holes 83*g* corresponding to each of the bosses 81*e* are formed on the outside of the center hole 83*f* This shaft fixing member 83 is attached to the rotation shaft 81 by screwing male screws (not illustrated) that pass through the counterbore holes 83*g* in the bosses with screw holes 81*e*.

This shaft part 50B, for example, is joined to a trunk part (not illustrated) by a male screw (not illustrated) screwed into the female screw 83*d*.

According to the top toy having the shaft part 50B configured in this way, the same actions and effects as those of the top toy 1 are exhibited.

Modification Example Top Toy 1B

Figure 20:
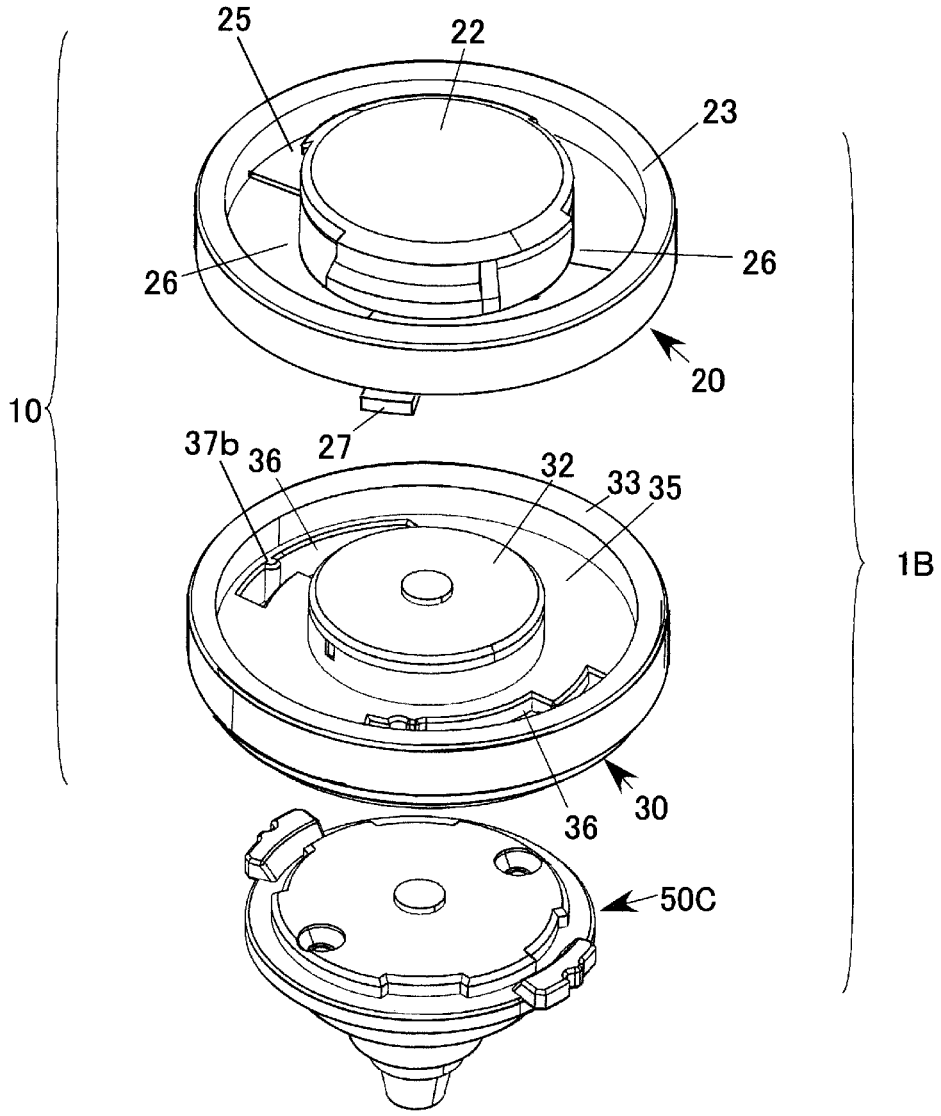
FIG. 20 is an exploded perspective view of another top toy.
Figure 21:
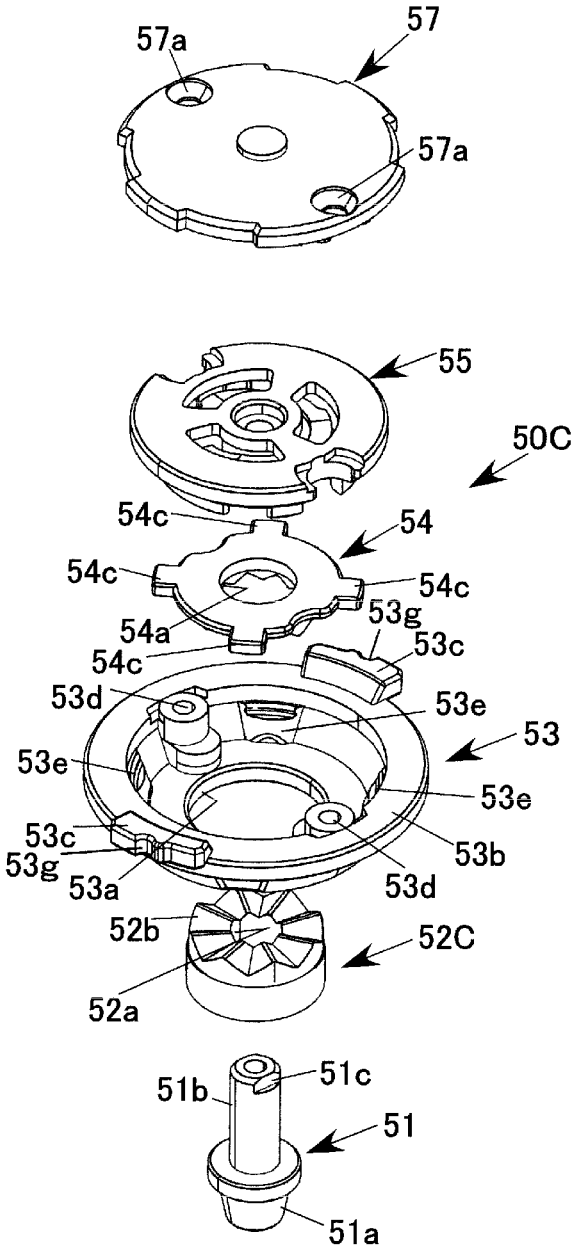
FIG. 21 is an exploded perspective view of the shaft part of another top toy seen from the top surface side.
Figure 22:
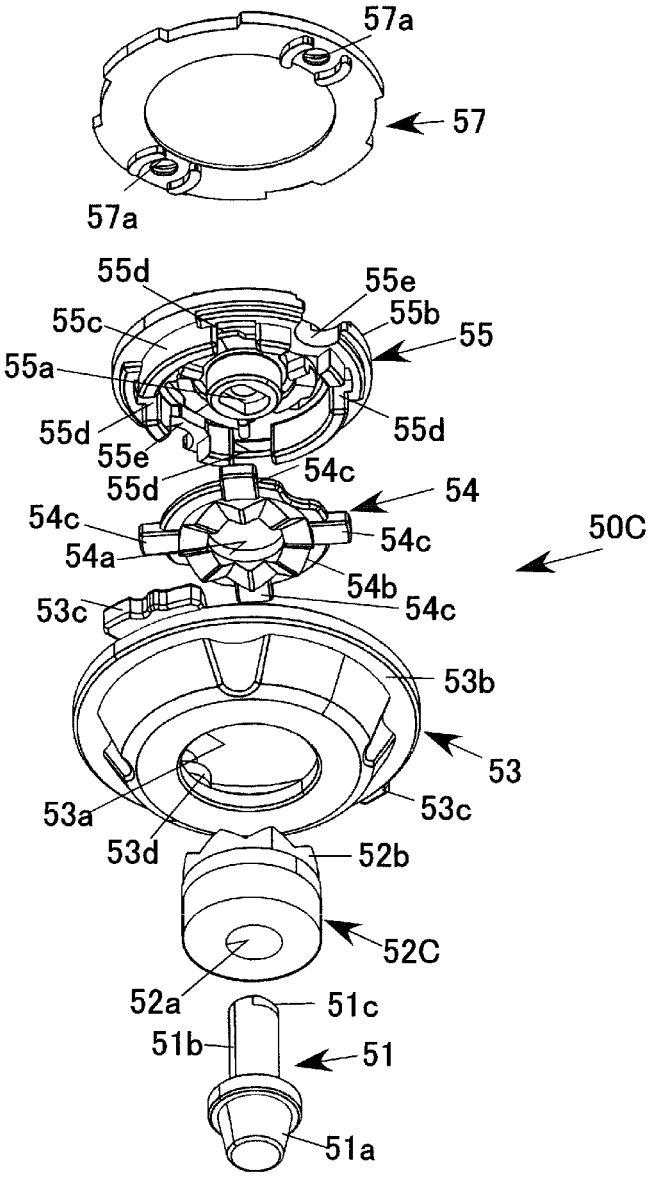
FIG. 22 is an exploded perspective view of the shaft part of another top toy seen from the bottom surface side.

FIG. 20 is an exploded perspective view of a top toy 1B which is a modification example of the top toy 1. FIG. 21 is an exploded perspective view of the shaft part of the top toy 1B seen from the top surface side. FIG. 22 is an exploded perspective view of a shaft part 50C seen from the bottom surface side. The parts indicated by the code numbers given in these drawings have the same configuration as the parts given the same numbers in FIG. 4, FIG. 5, and FIG. 6, so their explanation is omitted as appropriate.

The point of difference in this top toy 1B from the top toy 1 is the point that a roller 52C is provided instead of the gear 52. The outer peripheral surface of the roller 52C is formed from a material that has strong frictional resistance, such as rubber, a file, a brush, cloth, Velcro (registered trademark), and an adhesive material.

Figure 23:
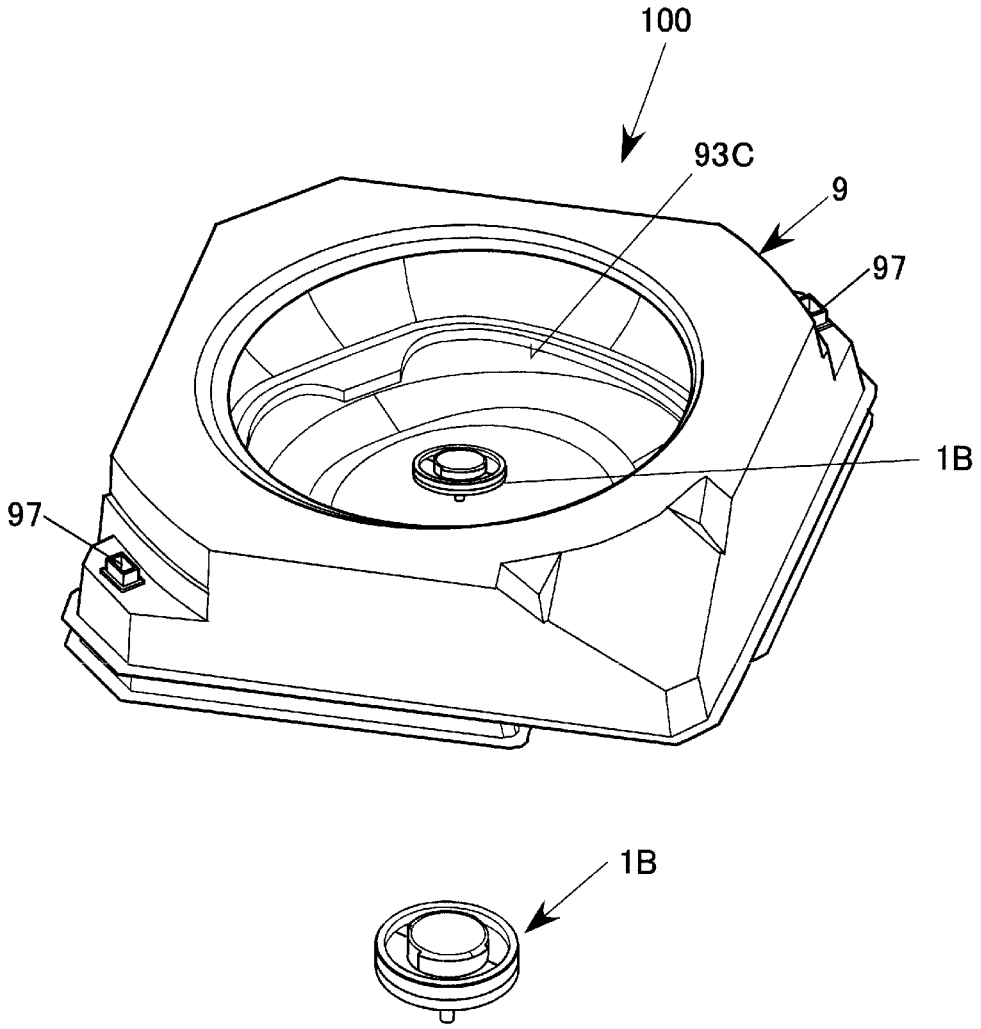
FIG. 23 is a perspective view of another top toy set of an embodiment.

This top toy 1B exhibits particularly meaningful effects with a top toy game table 9B shown in FIG. 23. The guide surface of a guide member 93B of the top toy game table 9B in this case is preferably formed from a material that has strong frictional resistance, such as rubber, a file, a brush, cloth, Velcro (registered trademark), and an adhesive material.

When this top toy 1B is released into the battlefield 92, it moves around in reaction in the direction opposite to the rotation direction of the top toy 1B. At this time, the roller 52C integrally rotates with the rotation shaft 51. By this moving around, the roller 52C of the top toy 1B also contacts the guide member 93B. By the impact force at this time, the roller 52C rotates relatively in resistance to the energizing force of the plate springs 55*f* (see FIG. 7) with respect to the rotation shaft 51, and mitigates the impact. As a result, it is easier for the roller 52C to abut the guide member 93B, sliding is suppressed by the frictional resistance of the roller 52C, and in a half-clutch state, the roller 52C is rotated in accordance with the rotation of the rotation shaft 51 and moves along the guide member 93B, and the movement of the top toy 1B is accelerated. In other words, it is easier for the rotation of the top toy 1B to be transmitted to the guide member 93B, and possible to accelerate the movement of the top toy 1B.

Other Modification Examples

With the abovementioned embodiments, the guide member 93 was provided fixed to the top toy game table 9, but it is also possible to have the guide member 93 be a separate body from the top toy game table 9, and for the player to directly hold the guide member 93 by hand and use that by approaching the top toy.

With the abovementioned embodiments, one gear that engages with the teeth of the guide member was provided on the rotation shaft, but it is also possible to provide a plurality of gears having a shaft on one circle concentric with the rotation shaft. Alternatively, it is also possible to provide a plurality of teeth forming members on which arc-shaped teeth are formed in the circumferential direction.

It is also possible to replace the gears 52, 72, 82 in a case of the other shaft part 50A, the other top toy 1A, and the shaft part 50B of the modification examples with the roller 52C of the top toy 1B.

Effect of the Invention

According to the first aspect, when the second teeth are engaged with the first teeth, the top toy rolls along the guide member without sliding, so can be moved effectively. When the second gear is fixed to the body, by engagement of the second teeth and the first teeth, the rotation of the top toy is transmitted to the guide member, and it is possible to rapidly accelerate the movement of the top toy. In this way, it is possible change the movement by the amount of engagement of the second teeth and the first teeth.

According to the second aspect, when the second teeth are abutted on the guide member, playing is difficult, and engaging of the second teeth and the first teeth is easier.

According to the third aspect, the teeth forming member is a gear for which the first teeth are provided on the rotation shaft, so the configuration of the teeth forming member is simple, and the attachment structure is also simple. Because it is a gear, it is also easy to use the dynamic force of the top toy.

According to the fourth aspect, because the resistance means are provided, the rotation of the top toy is transmitted to the first teeth of the guide member via the teeth forming member, so it is possible to increase the speed at which the top toy moves around.

According to the fifth aspect, when the gear collides with the guide member, the gear rotates in the direction that mitigates impact on the rotation shaft, so it is easier for the first teeth to engage with the second teeth. After engagement of the first teeth and the second teeth, by the first teeth rotating in accordance with the rotation of the rotation shaft, the speed at which the top toy moves around increases.

According to the sixth aspect, by operation of the clutch, the first teeth and the second teeth engage easily, and it is possible to increase the speed at which the top toy moves around.

According to the seventh aspect, when the gear collides with the guide member, the gear is rotated in resistance to the energizing force of the plate spring in the direction that mitigates the impact on the rotation shaft, so the impact is effectively absorbed, and it is easier for the first teeth to engage with the second teeth. After the first teeth engage with the second teeth, by the gear rotating in accordance with the rotation of the rotation shaft, the speed at which the top toy moves around increases.

According to the eighth aspect, when the gear collides with the guide member, the gear is rotated in resistance to the energizing force of the coil spring in the direction that mitigates impact on the rotation shaft, so it is possible to obtain the same effect as that of the seventh aspect.

According to the ninth aspect, when the gear collides with the guide member, the friction clutch rotates the gear in the direction that mitigates the impact on the rotation shaft, so it is possible to obtain the same effect as with the seventh aspect.

According to the tenth aspect, when the gear collides with the guide member, the elastic member is elastically deformed and the gear is rotated in the direction that mitigates impact on the rotation shaft, so it is possible to obtain the same effect as with the seventh aspect.

According to the eleventh aspect, it is possible to change the characteristics of the top toy by replacing the abutting member.

Specifically, when using the abutting member for which the abutting part is formed at a relatively far distance from the projection, the dynamic resistance between the rotation shaft and the gear is small, and when using the abutting member for which the abutting part is formed at a relatively close distance from the projection, the dynamic resistance between the rotation shaft and the gear is large.

According to the twelfth aspect, it is possible to realize a top toy set that effectively exhibits the function of the top toys of the first to eleventh aspect.

According to the thirteenth aspect, when the first frictional resistance part abuts the guide member, the top toy rolls along the guide member, so it is possible to move it effectively. When the first frictional resistance part is fixed to the body, by the abutting of the first frictional resistance part and the guide member, the rotation of the top toy is transmitted to the guide member, and it is possible to accelerate the movement of the top toy. In this way, it is possible to change the movement by the amount that the first frictional resistance part and the guide member abut.

According to the fourteenth aspect, when the first frictional resistance part is abutted on the guide member, playing is difficult, and abutting of the first frictional resistance part and the guide member is easier.

According to the fifteenth aspect, the first frictional resistance part is the roller provided on the rotation shaft, so the configuration is simple, and the attachment structure is also simple. Since this is a roller, it is also easy to use the dynamic force of the top toy.

According to the sixteenth aspect, the first frictional resistance part abuts the second frictional resistance part of the guide member, so the grip force further increases, and the roller rolls more easily.

According to the seventeenth aspect, because the resistance means is provided, the rotation of the top toy is transmitted to the guide member via the first resistance part, and the speed at which the top toy moves around can be increased.

According to the eighteenth aspect, when the roller collides with the guide member, the roller rotates in the direction that mitigates impact, so the roller more easily abuts the guide member. After abutting of the roller and the guide member, by the roller rotating in accordance with the rotation of the rotation shaft, the speed at which the top toy moves around increases.

According to the nineteenth aspect, by operation of the clutch, the first frictional resistance part and the second frictional resistance part easily abut, and it is possible to increase the speed at which the top toy moves around.

According to the twentieth aspect, when the roller collides with the guide member, the roller rotates in resistance to the energizing force of the plate spring in the direction that mitigates impact, so abutting of the roller and the guide member is easier. After abutting of the roller and the guide member, by the roller rotating in accordance with rotation of the rotation shaft, the speed at which the top toy moves around increases.

According to the twenty-first aspect, when the roller collides with the guide member, the roller rotates in resistance to the energizing force of the coil spring, in the direction that mitigates impact, so it is possible to obtain the same effects as with the twentieth aspect.

According to the twenty-second aspect, when the roller collides with the guide member, the friction clutch rotates the roller in the direction that mitigates impact, so it is possible to obtain the same effect as with the twentieth aspect.

According to the twenty-third aspect, when the roller collides with the guide member, the elastic member is elastically deformed and rotates the gear in the direction that mitigates impact on the rotation shaft, so it is possible to obtain the same effect as with the twentieth aspect.

According to the twenty-fourth aspect, it is possible to change the characteristics of the top toy by exchanging the abutting member.

Specifically, when using the abutting member for which the abutting part is formed at a relatively far distance from the projection, the dynamic resistance between the rotation shaft and the roller is smaller, and when using the abutting member for which the abutting part is formed at a relatively close distance to the projection, the dynamic resistance between the rotation shaft and the roller is greater.

According to the twenty-fifth aspect, it is possible to realize a top toy set that effectively exhibits the functions of the top toys of the thirteenth to twenty-fourth aspect.

INDUSTRIAL APPLICABILITY

The top toy and the top toy set of the present invention can be suitably used in the field of manufacturing top toys and top toy sets.

The invention claimed is:

1. A top toy that is used in a game table including a guide member having a guide surface on which first teeth are formed at an equal interval, the top toy comprising:

a shaft part;

a body being configured on the shaft; and a trunk part being configured on the shaft, the shaft part including second teeth that are engageable with the first teeth on an outer periphery thereof.

2. The top toy according to claim 1, wherein the second teeth are formed on a teeth forming member, and the teeth forming member is provided to operate with respect to the body.

3. The top toy according to claim 2, wherein the shaft part includes a rotation shaft extending in a top-to-bottom direction, and the teeth forming member is a gear provided on the rotation shaft that rotates integrally with the body.

4. The top toy according to claim 2, further comprising a resistance part being dynamic resistance configured between the body and the teeth forming member.

5. The top toy according to claim 4, wherein the teeth forming member is a gear provided on a rotation shaft, and the resistance part is configured to rotate the rotation shaft and the gear integrally, when impact is applied to the gear, the resistance part is configured to rotate the gear relative to the rotation shaft, and when the second teeth and the first teeth are engaged, the resistance part is configured to rotate the gear along the guide member by rotation of the gear in accordance with the rotation of the rotation shaft.

6. The top toy according to claim 5, wherein the resistance part is made of a clutch.

7. The top toy according to claim 6, wherein the clutch is an engagement clutch including a claw member, the claw member includes first and second claw parts, and a plate spring, the first claw part is formed at one end in an axial direction of the gear, the second claw part is prohibited from rotating relative to the rotation shaft, is configured to move in the axial direction, and is engageable with the first claw part, the plate spring is configured on the body to engage the second claw part with the first claw part by urging the claw member, and in a half-clutch state, the plate spring is configured to roll the gear along the guide member while engaging the second teeth and the first teeth.

8. The top toy according to claim 6, wherein the clutch is an engagement clutch including a claw member, the claw member includes first and second claw parts, and a coil spring, the first claw part is formed at one end in an axial direction of the gear, the second claw part is prohibited from rotating relative to the rotation shaft, is configured to move in the axial direction, and is engageable with the first claw part, the coil spring is configured on the body to engage the second claw part with the first claw part by urging the claw member, and in a half-clutch state, the coil spring is configured to roll the gear along the guide member while engaging the second teeth and the first teeth.

9. The top toy according to claim 6, wherein the resistance part is made of a friction clutch configured between the body and the gear, and in a half-clutch state, the friction clutch is configured to roll the gear along the guide member while engaging the second teeth and the first teeth.

10. The top toy according to claim 6, wherein the resistance part is made of a mechanical clutch, the mechanical clutch includes an engaging part, an elastic member, and an abutting member, the engaging part is made of a recess and a projection, and is configured to rotate integrally with the gear, the elastic member is configured on a radial outside of the engaging part, and has a projection that is configured to engage with the recess of the engaging part, and the abutting member includes an abutting part at a location separated from the projection of the elastic member, and, the abutting member fits the projection of the elastic member into the recess by abutting on the abutting part, and the abutting member, in a half-clutch state, is configured to roll the gear along the guide member while engaging the second teeth and the first teeth.

11. The top toy according to claim 10, further comprising a second abutting member that is exchangeable with the abutting member, the second abutting member includes a second abutting part, a first distance between the abutting part and the projection of the elastic member is different from a second distance between the second abutting part and the projection of the elastic member.

12. A top toy set comprising the top toy of claim 1, and the game table provided with the guide member fixed.

13. A top toy that is used together with a guide member, comprising a body configured from a shaft part and a trunk part, and the body including a first frictional resistance part abutting with a guide surface of the guide member on an outer periphery thereof, the top toy further including a resistance part being dynamic resistance configured between the body and the first frictional resistance part, the resistance part being configured to rotate the rotation shaft and the roller integrally, the resistance part is made of a clutch.

14. The top toy according to claim 13, wherein the first frictional resistance part is configured to operate with respect to the body.

15. The top toy according to claim 14, wherein
the first frictional resistance part is a roller configured on a rotation shaft, and
the rotation shaft is configured to rotate integrally with the body.

16. A top toy set comprising:
the top toy according to claim 14, and
a top toy game table provided with the guide member fixed.

17. The top toy according to claim 13 wherein
the guide surface of the guide member includes a second frictional resistance part, and
the second frictional resistance abuts the first frictional resistance part.

18. The top toy according to claim 17, wherein
the first frictional resistance part is a roller configured on a rotation shaft,
the first frictional resistance part is configured to rotate integrally with the body,
when impact is applied to the roller, the first frictional resistance part is configured to rotate the roller relative to the rotation shaft, and
when the roller abuts the guide member, the first frictional resistance part is configured to roll the roller along the guide member by rotation of the roller in accordance with the rotation of the rotation shaft.

19. The top toy according to claim 18, wherein
the resistance part is an engagement clutch including a claw member,
the claw member includes first and second claw parts, and a plate spring,
the first claw part is formed on one end in an axial direction of the roller,
the second claw part is prohibited from rotating relative to the rotation shaft, is configured to move in the axial direction, and is engageable with the first claw part,
the plate spring is configured on the body to engage the second claw part with the first claw part by urging the claw member, and
in a half-clutch state, the plate spring is configured to roll the roller along the guide member.

20. The top toy according to claim 18, wherein
in a half-clutch state, the clutch is configured to roll the roller along the guide member.

21. The top toy according to claim 18, wherein
the resistance part is configured from a mechanical clutch,
the mechanical clutch includes an engaging part, an elastic member, and an abutting member,
an engaging part is made of a recess and a projection and is configured to rotate integrally with the roller,
the elastic member is configured on a radial outside of the engaging part, and has a projection being configured to engage with the recess, and
the abutting member including an abutting part at a location separated from the projection of the elastic member,
the abutting member fits the projection of the elastic member into the recess, and
the abutting member, in a half-clutch state, is configured to roll the roller along the guide member.

22. The top toy according to claim 21, further comprising
a second abutting member that is exchangeable with the abutting member,
the second abutting member includes a second abutting part,
a first distance between the abutting part and the projection of the elastic member is different from a second distance between the second abutting part and the projection.

* * * * *